US008484925B2

(12) United States Patent
Daas et al.

(10) Patent No.: US 8,484,925 B2
(45) Date of Patent: Jul. 16, 2013

(54) LATTICE SUPPORT STRUCTURE

(75) Inventors: Kamal Daas, Bergschenhoek (NL); Doron Livnat, Rotterdam (NL)

(73) Assignees: Kamal Daas, Bergschenhock (NL); ProData Investments b.v., Rotterdam (NL)

( * ) Notice: Subject to any disclaimer, the term of this patent is extended or adjusted under 35 U.S.C. 154(b) by 195 days.

(21) Appl. No.: 12/865,219

(22) PCT Filed: Jan. 29, 2009

(86) PCT No.: PCT/EP2009/000581

§ 371 (c)(1),
(2), (4) Date: Jul. 29, 2010

(87) PCT Pub. No.: WO2009/095243

PCT Pub. Date: Aug. 6, 2009

(65) Prior Publication Data

US 2010/0326004 A1 Dec. 30, 2010

(30) Foreign Application Priority Data

Jan. 29, 2008 (DE) ..... 20 2008 001 272 U

(51) Int. Cl.
*E04H 12/18* (2006.01)

(52) U.S. Cl.
USPC ..... 52/646; 52/645

(58) Field of Classification Search
USPC ..... 52/646, 645, 641, 638
See application file for complete search history.

(56) References Cited

U.S. PATENT DOCUMENTS

| | | | | |
|---|---|---|---|---|
| 4,479,340 | A * | 10/1984 | Alphonse et al. | 52/646 |
| 4,763,459 | A * | 8/1988 | Wesselski | 52/646 |
| 4,791,761 | A | 12/1988 | Goudie | |
| 5,016,418 | A | 5/1991 | Rhodes et al. | |
| 5,765,248 | A * | 6/1998 | Ono | 14/75 |
| 6,000,175 | A * | 12/1999 | Gale et al. | 52/63 |
| 6,161,359 | A * | 12/2000 | Ono | 52/651.1 |
| 6,499,266 | B1 * | 12/2002 | Macumber | 52/694 |
| 7,296,699 | B2 * | 11/2007 | Hung et al. | 211/189 |
| 2005/0262779 | A1 | 12/2005 | Zeigler | |

FOREIGN PATENT DOCUMENTS

| | | |
|---|---|---|
| EP | 884425 | 12/1998 |
| GB | 117199 | 7/1918 |

* cited by examiner

*Primary Examiner* — Basil Katcheves
(74) *Attorney, Agent, or Firm* — Dilworth & Barrese, LLP.

(57) ABSTRACT

The present invention relates to a lattice support structure having longitudinally extending supports which are connected to one another by obliquely extending struts and are also connected to one another in the state of the lattice support structure ready for operation by transversely extending struts provided with a joint, with the struts being pivotably connected to two respective preferably adjacent supports, with at least one connection strut being provided which connects two supports to one another which are not adjacent to one another and which are preferably disposed opposite one another, and with the at least one connection strut and/or at least one component of the lattice support structure connected thereto having fastening means or being connected or connectable thereto, with the fastening means being made such that they prevent a folding together of the lattice support structure in at least one position.

15 Claims, 12 Drawing Sheets

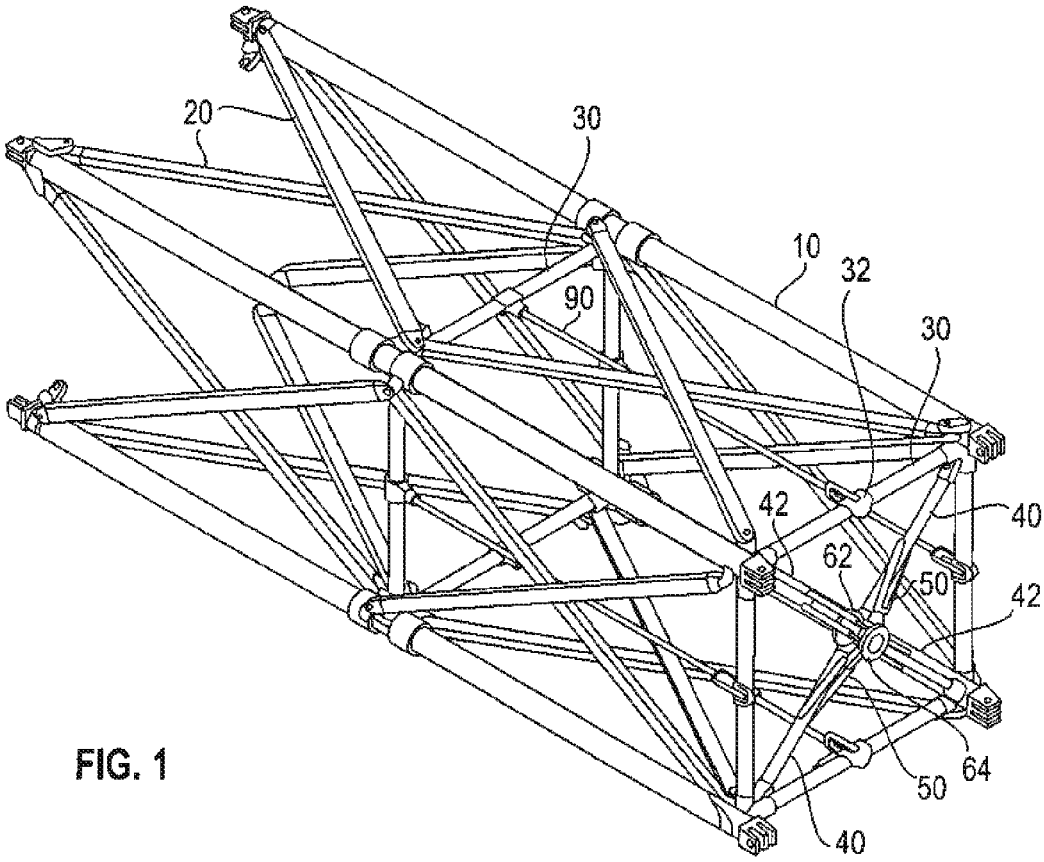
FIG. 1
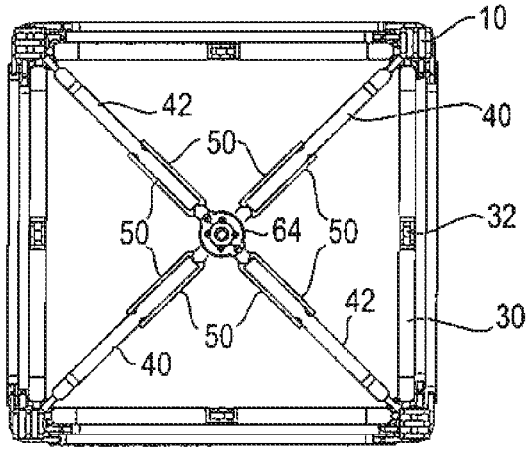

LATTICE SUPPORT STRUCTURE

BACKGROUND OF THE INVENTION

The present invention relates to lattice support structure.

Such lattice support structures are known in different embodiments. Lattice support structures are known whose outer dimensions can be decreased by being folded together and can be increased again by folding apart the framework of the lattice support structure.

SUMMARY OF THE INVENTION

Such lattice support structures bring along the advantage that the lattice support structure can be folded up for the purpose of transport and thus takes up less room and only has to be folded apart into the state ready for operation just before its use.

It is the underlying object of the present invention to further develop such a lattice support structure such that it can be secured simply and reliably in its set-up state.

This object is solved by a lattice support structure having the features herein.

Provision is accordingly made for the lattice support structure to have longitudinally extending supports which are connected to one another by obliquely extending struts and also, in the state of the lattice support structure ready for operation, by transversely extending struts provided with a joint, with the struts being pivotably connected to two respective preferably adjacent supports, with at least one connection strut being provided which connects two supports to one another which are not adjacent to one another and which are preferably disposed opposite one another. Provision is furthermore made that the at least one connection strut and/or at least one component of the lattice support structure connected thereto, such as one or more levers pivotably connected to the connection strut, has fastening means or is connected or connectable thereto with the fastening means being made such that they prevent a folding together of the unfolded lattice support structure in at least one position.

In this respect, a preferred embodiment of the invention comprises the connection strut being connected to a first fastening flange and first and second levers being pivotally connected to the at least one connection strut, said first and second levers being connected to a second fastening element and with the fastening elements being arranged such that they can be connected to one another. In the mutually connected state of the fastening elements, they are locked with respect to one another so that the lattice support structure is secured in the unfolded state.

The levers project comparatively far from the connection strut or struts in the state of the lattice support structure folded together. The two fastening elements are accordingly spaced comparatively far away from one another.

If the lattice support structure is brought into its operating position, the angle between the levers and the connection struts decreases, whereby the fastening elements can be moved toward one another and can be secured in a suitable manner after reaching their end position.

The total lattice support structure is secured against being folded together in this state since the fastening elements prevent the connection struts, and thus the total lattice support structure, from being able to be folded together.

The invention furthermore relates to a lattice support structure having longitudinally extending struts which are connected to one another by obliquely extending struts, with one of both end regions of the one, several or all of the obliquely extending struts being connected directly or indirectly to at least one of the longitudinally extending struts such that the obliquely extending strut is displaceable in at least one of the end regions relative to the longitudinally extending support. It is conceivable that sliding elements preferably sliding sleeves are provided which are preferably pivotable, which are connected to an end region of the obliquely extending struts and which run on the longitudinally extending supports. Provision is made in a possible embodiment that the obliquely extending strut(s) is/are pivotable with such a sliding element in one end region and is/are arranged in its/their other end region in a spatially fixed, but pivotable manner at the longitudinally extending supports.

Any desired combinations of the above-described embodiments of a lattice support structure or of its features are also covered by the invention.

Two connection struts can be provided which e.g. extend cross-ways and which are both connected to the first fastening element.

It is conceivable that the lattice support structure has a square or rectangular design in cross-section, with the corners of the square or of the rectangle being formed by the longitudinally extending supports and with the connection struts extending diagonally such that they connect two supports with one another disposed in oppositely disposed corners.

Provision is made in a further embodiment of the invention for the at least one connection strut to be pivotably connected to the first fastening element.

The lever or levers can be pivotably connected to the second fastening element.

The fastening elements can be made such that they can be connected to one another by a clip or the like. If the lattice support structure has been completely folded apart, the clip, or also another fastening element, serves to effectively prevent a removal of the fastening elements and thus a folding together of the lattice support structure.

Provision is made in another embodiment of the invention for one of the fastening elements to have a flange-shaped part and pins extending therefrom and for the other of the fastening elements to have a flange-shaped part which includes cut-outs in which the pins can be at least partially received.

Provision can furthermore be made for the transversely extending struts provided with a joint to be spaced apart from one another in the longitudinal direction and for a connection element to be provided which connects two joints of two such struts or two struts to one another.

This has the result that the movement of a strut by means of the connection element results in a corresponding movement of the adjacent strut.

Provision can furthermore be made for at least one blocking element to be provided which prevents an inward pivoting of the transversely extending struts in the state of the lattice support structure ready for operation. This blocking element can be made self-locking, which means that it moves into its locking position when the lattice support structure has been fully folded apart.

Provision is made in a further embodiment of the invention that the lattice support structure has struts which are made in the form of a pyramid or in the form of a truncated pyramid. These structures can be arranged simply or in repeated form in the longitudinal direction of the lattice support structure, with the structures being able to be arranged in the same direction or in opposite directions in the case of a plurality of these structures. The pyramids or truncated pyramids are preferably located in the interior of the lattice support structure. They can be made such that a middle longitudinal axis of the lattice support structure extends through the tips of these structures.

The present invention furthermore relates to a lattice support structure having longitudinally extending supports which are connected to one another by obliquely extending struts and also by transversely extending struts provided with a joint in the state of the lattice support structure ready for operation, with the struts being pivotably connected by a respective two adjacent supports and with a central element being provided, starting from which struts extend to the longitudinally extending supports, with the struts extending at an acute angle to the longitudinally extending supports at least in the state of the lattice support structure ready for operation.

This lattice support structure can be made in accordance with the features herein.

The invention furthermore relates to a lattice support structure having spreadable structures, in particular a lattice support structure in accordance with one of the claims 1 to 16, which is characterized in that the lattice support structure has pivotably arranged lattice bars or struts, with the pivotable connection being made such that one of the mutually pivotably connected parts has a projection and that the other of the pivotably connected parts has a groove which is bounded by walls on three sides and in which the projection of the other part is pivotably received. These lattice rods or struts can, for example, be the struts of the aforesaid embodiments of a lattice support structure.

The groove base thus serves as a boundary such that a pivoting of the lattice bar is only possible by so much until the one of the named parts lies on the groove base. In this position, the lattice bar is thus blocked or a further pivoting is not possible. Such a pivotable connection can be provided wherever two segments of a lattice bar are mutually pivotably connected to one another and/or wherever a lattice bar is pivotally connected to another part of the lattice support structure.

The lattice bar or the strut can have the projection at its one end region and the named groove at its other end region. It is possible in this manner to connect a plurality of lattice bars to one another or to provide lattice bars of different lengths. It is generally also conceivable to design both ends of the lattice bars with grooves or with the named projections.

The invention furthermore relates to a crane which comprises one or more lattice support structures in accordance with the description herein or at least has such a support structure.

BRIEF DESCRIPTION OF THE DRAWINGS

Further details and advantages of the invention will be explained in more detail with reference to an embodiment shown in the drawing. There are shown:

FIG. 1: a perspective view and a plan view of the lattice support structure in accordance with the invention in the folded apart state;

DESCRIPTION OF THE PREFERRED EMBODIMENTS

Figure 2:
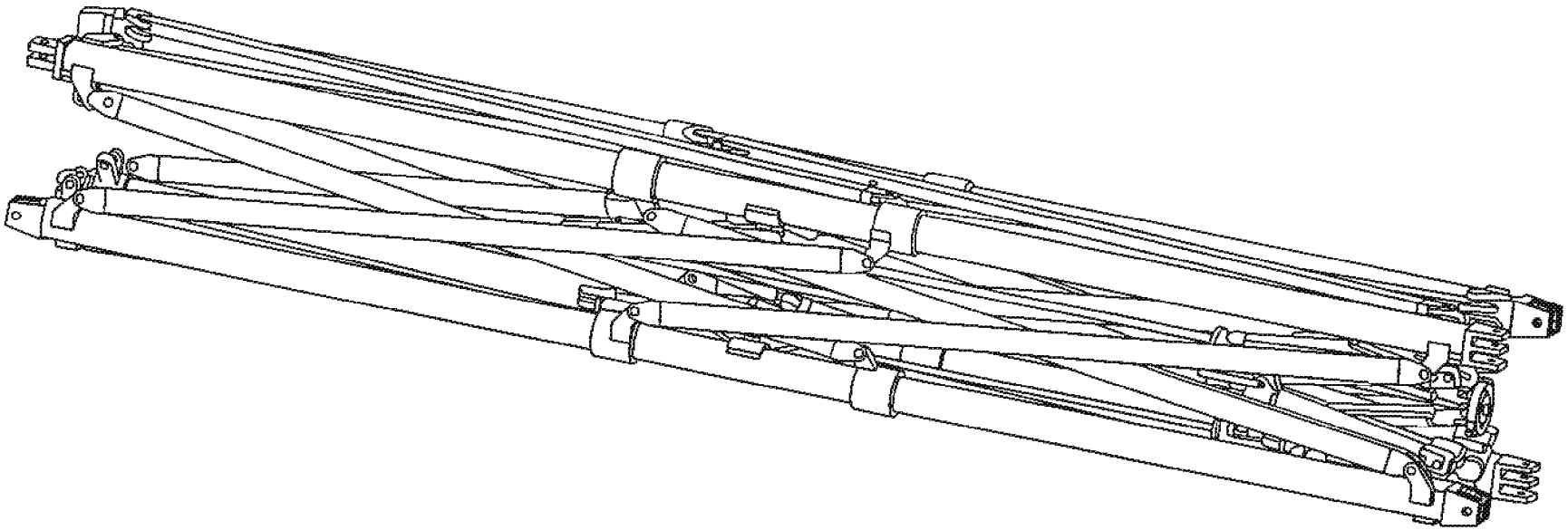
FIG. 2: a perspective view of the lattice support structure in accordance with FIG. 1 in the folded together state.

FIG. 1, upper representation, shows the lattice support structure in accordance with the invention in a perspective view in the state folded apart. The lattice support structure is square in cross-section. The corners of the square are formed by longitudinally extending supports 10 which are connected to one another by obliquely extending and intersecting struts 20, as can be seen from FIG. 1.

The struts 20 are arranged pivotably at the supports 10. They form the outer surface of the support structure.

Furthermore, transversely extending struts 30, which are provided centrally with a joint 32 which allows its inward pivoting, extend between the struts 10.

Two struts 30 adjacent in the longitudinal direction of the lattice support structure are connected to one another by a connection element 90 which has the task of transmitting the pivot movement of a strut 30 to a pivot movement of the adjacent strut 30.

Connection struts 40, 42 are furthermore provided which each connect two diagonally opposite supports of the lattice support structure to one another, as can be seen from FIG. 1. The struts 40, 42 are thus located on the end-face side of the lattice support structure segment shown in the state folded apart.

They are arranged pivotably at the supports 10 in their end regions, and indeed at the level of the pivotal connection of the struts 30.

Respective pivotable levers which are pivotally connected to a fastening element 64 are connected to the connection struts 40, 42. The struts 40, 42 are likewise pivotably connected at their middle regions to a further fastening element 62. FIG. 1, bottom representation, shows the arrangement in a top view.

FIG. 2 shows the lattice support structure in accordance with FIG. 1 in the state folded together. It is here a lattice support structure segment which can be assembled with further lattice support structures. The mounts arranged in the end regions of the supports 10 serve this purpose, with the connection to further lattice support structure segments being secured e.g. by bolts.

Figure 3:
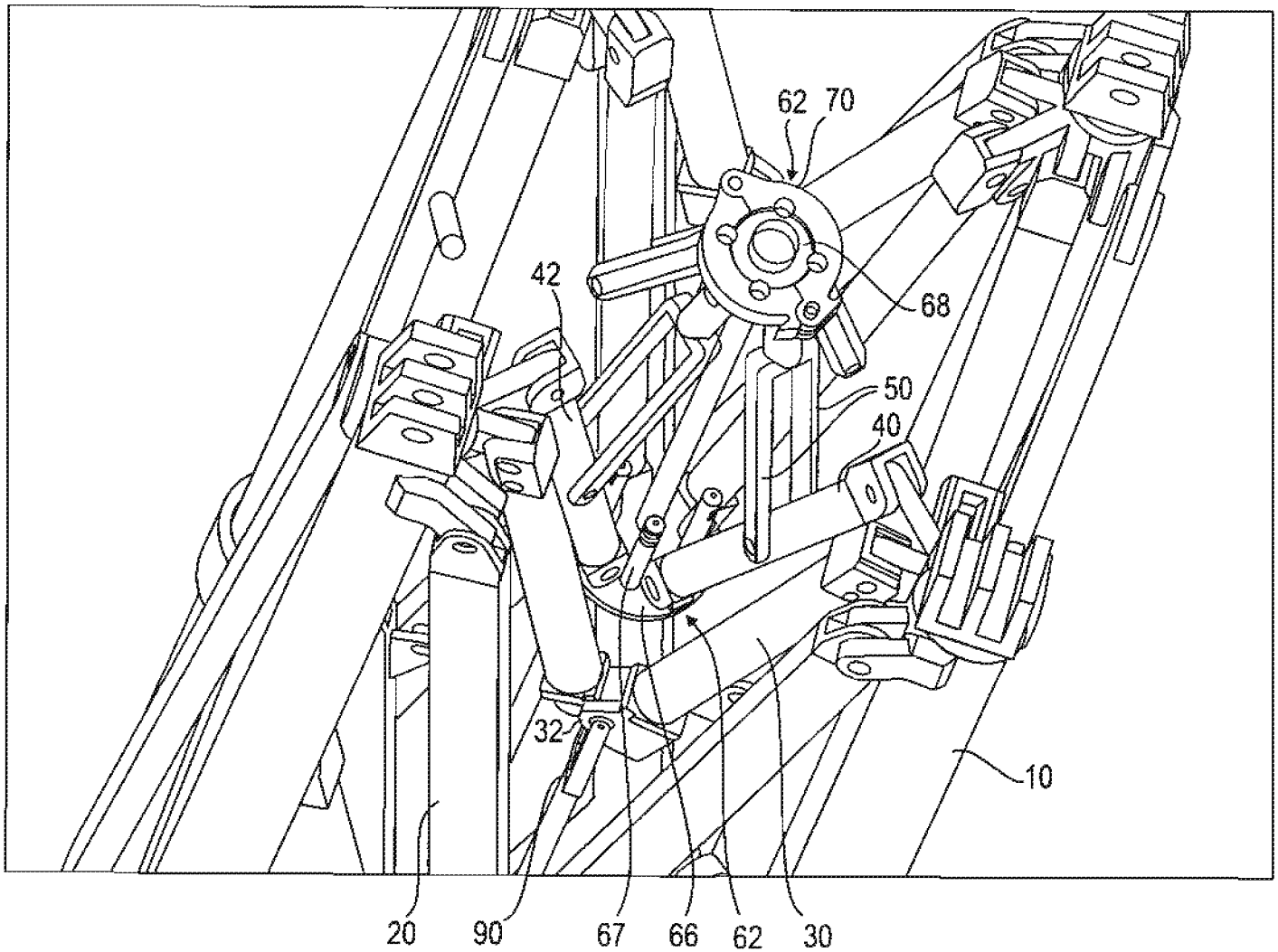
FIGS. 3-5: detailed representations of an end region of the lattice support structure in accordance with FIGS. 1 and 2.

FIG. 3 shows the end-face end section of the lattice support structure shown at the right in accordance with FIG. 1 in a partially folded together state.

It can be seen from this drawing that the levers 50 project at a comparatively large angle from the connection struts 40, 42 in this state.

The two fastening elements 62, 64 are spaced comparatively far apart from one another.

Figure 4:
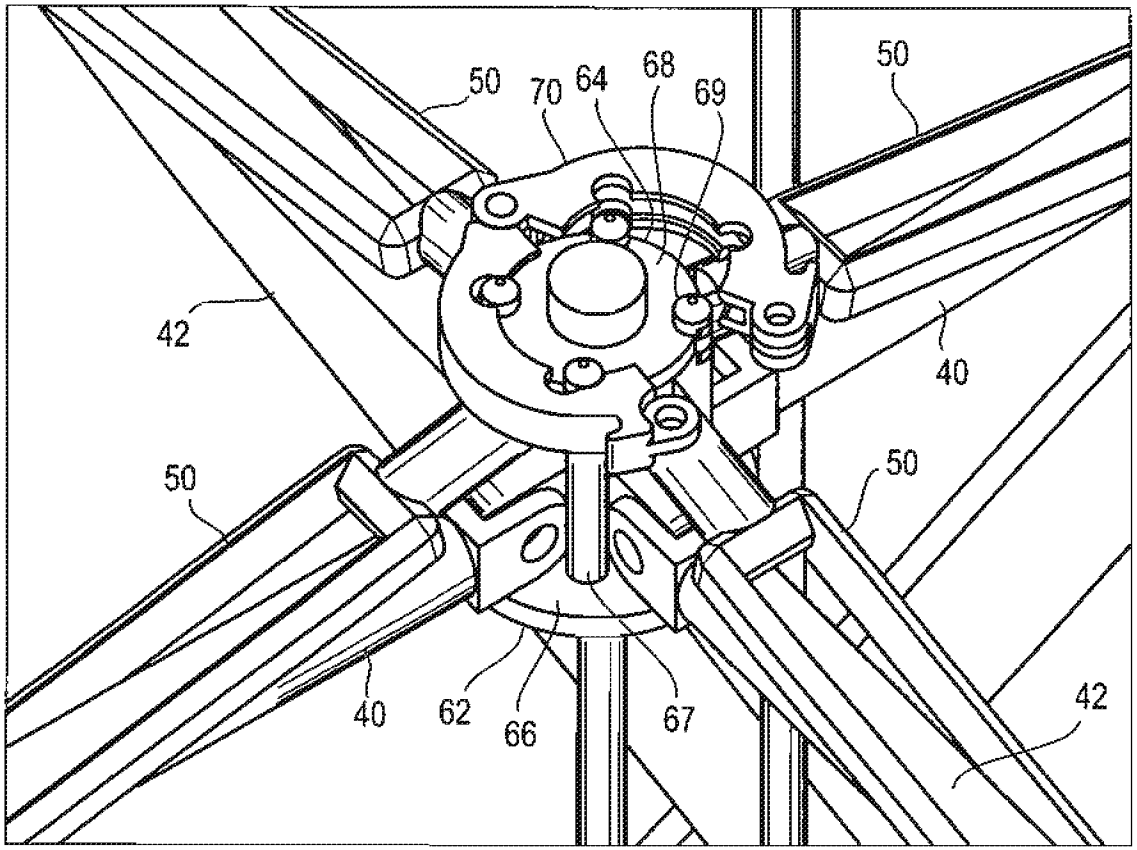

If, starting from this position, the lattice support structure is now folded apart, the position shown in FIG. 4 results. The levers 50 are now disposed approximately parallel to or at an acute angle to the connection struts 40, 42 and the spacing of the fastening elements 62, 64 from one another is comparatively large.

The fastening element 62 comprises a flange-shaped section 66 and pins 67 extending vertically therefrom. The fastening element 64 likewise comprises a flange-shaped section 68 and part-circular cut-outs 69 at the periphery which are dimensioned such that the pins 67 can be received therein, as is shown in FIG. 4. As soon as this is the case, the clip 70 is pivoted around the received sections of the pins 67 and around the flange 68 such that a moving apart of the fastening elements 62 and 64 is precluded.

Figure 5:
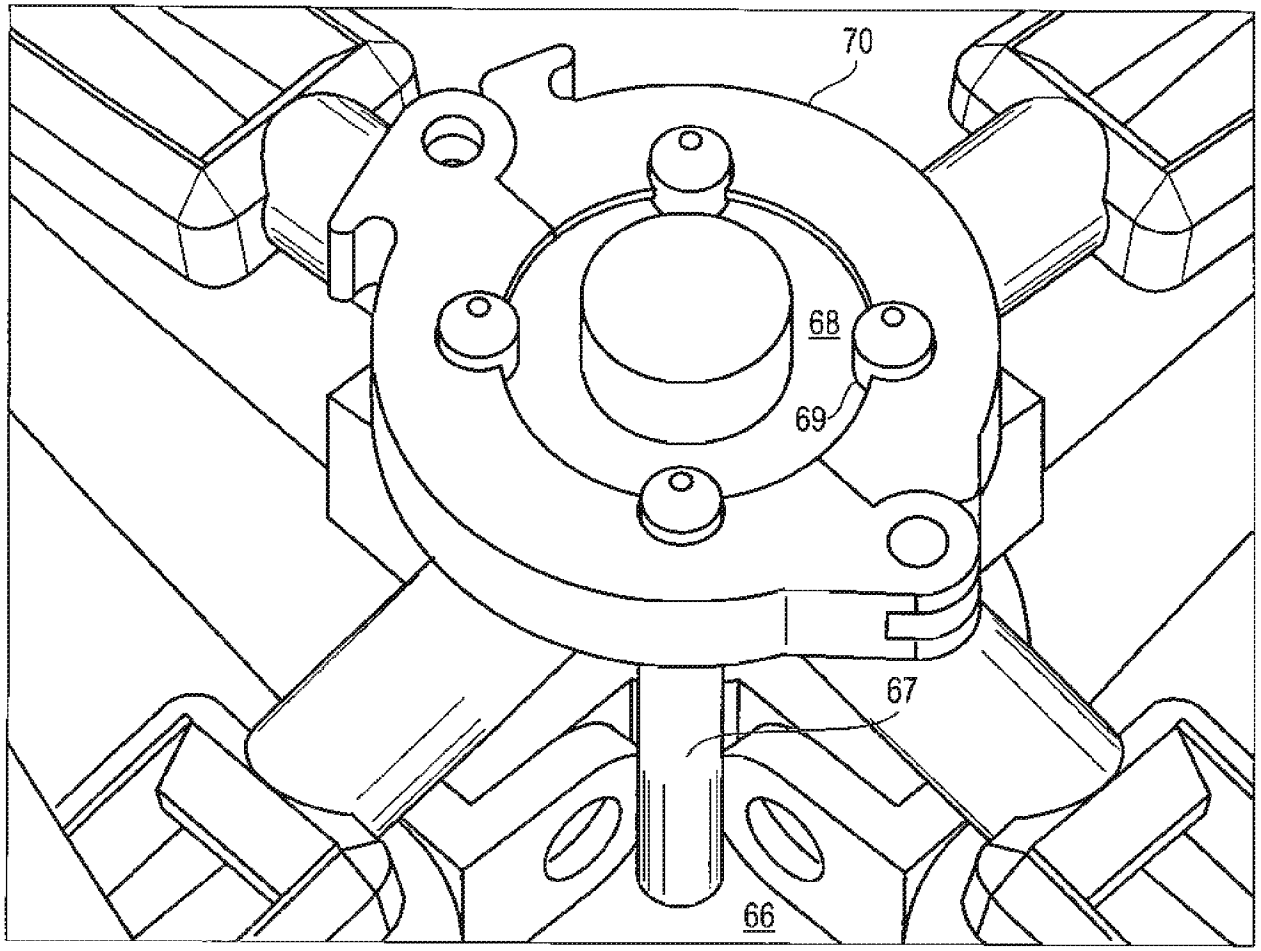

FIG. 5 shows this state.

Figure 6:
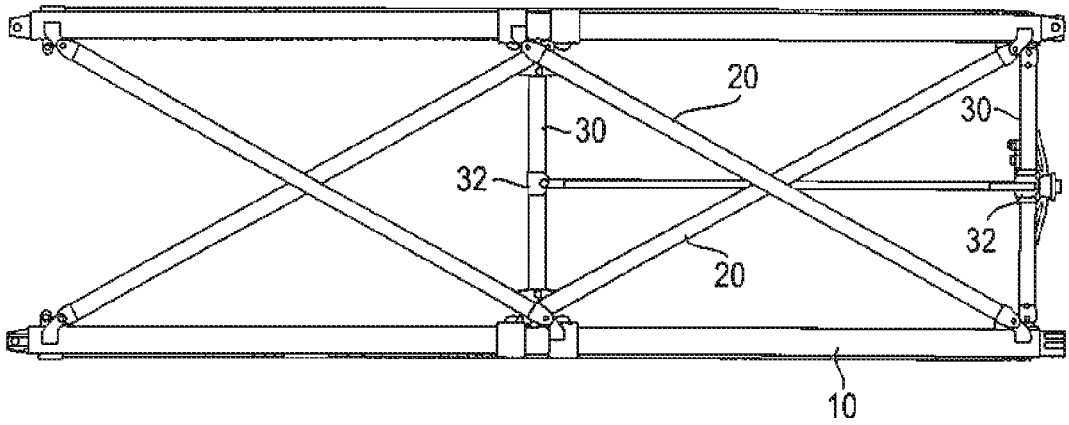
FIGS. 6, 7: representations of the lattice support structure in accordance with FIGS. 1 and 2 in a side view.

FIG. 6 shows the lattice support structure in a side view.

Figure 7:
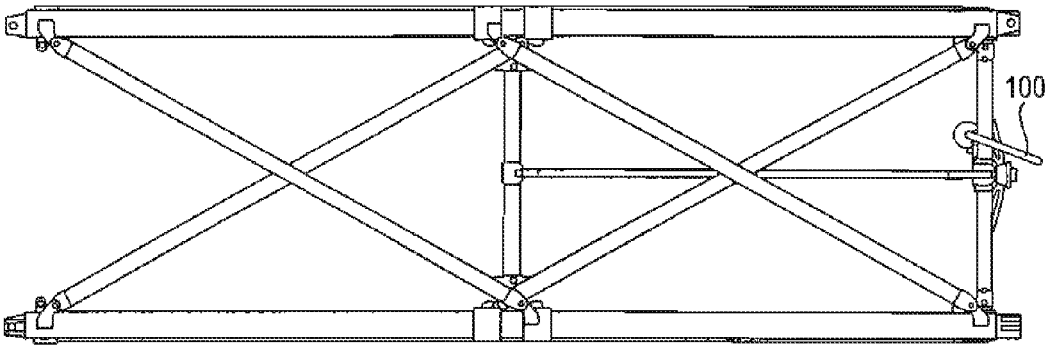
Figure 8:
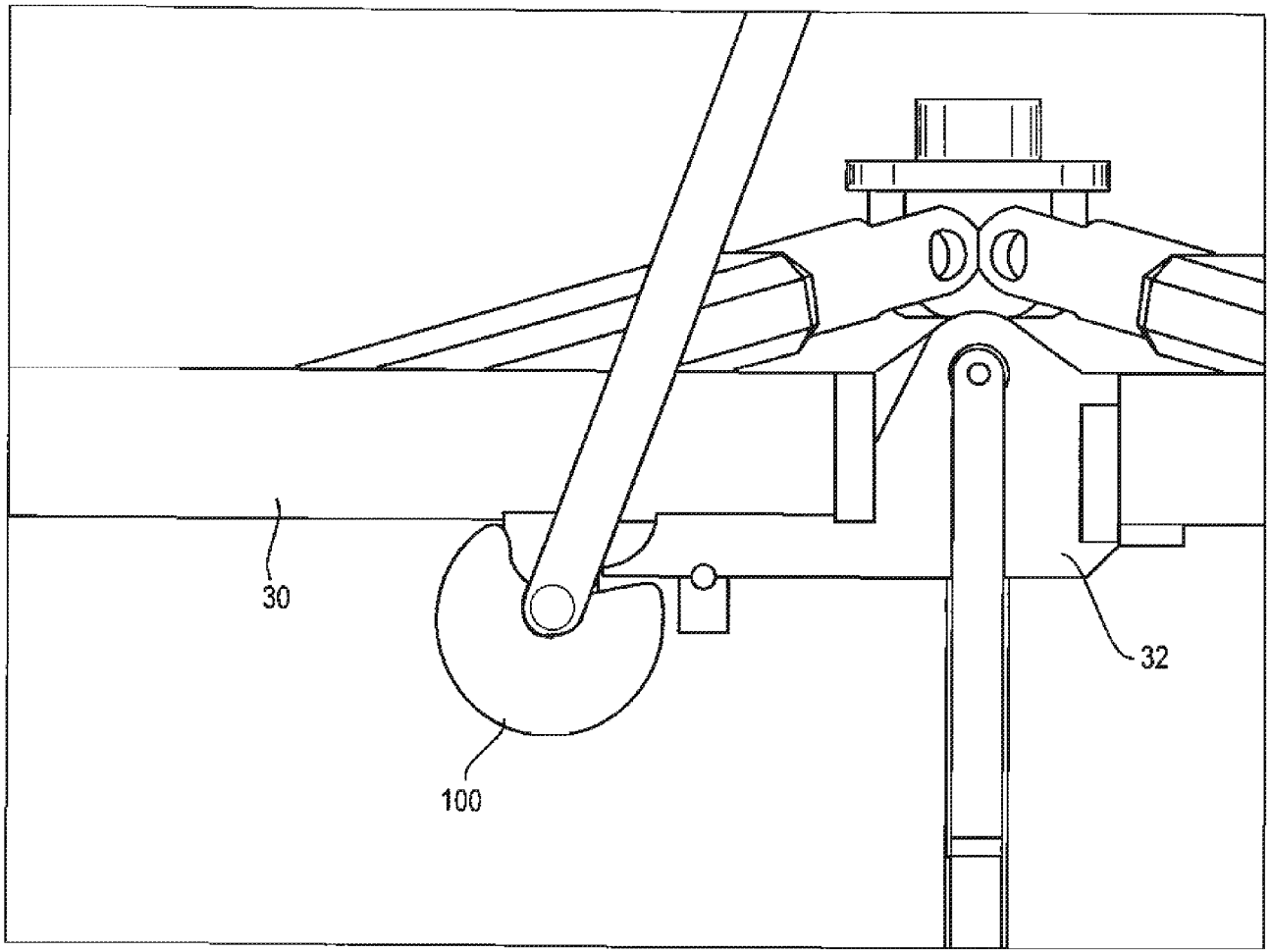
FIG. 8: a detailed representation of the blocking element of the lattice support structure in accordance with FIG. 7.

As can be seen from FIG. 7 and as is shown in detail in FIG. 8, the struts 30 which extend transversely in the state folded apart and which have a joint 32 are secured by a pawl 100. This pawl moves independently into its locking position as soon as the struts 30 have been outwardly pivoted into their shown position.

For the release, the pawl 100 is actuated whereupon the pivoting of the struts 30 around the joint 32 and thus also the folding together of the lattice support structure is possible.

Figure 9:
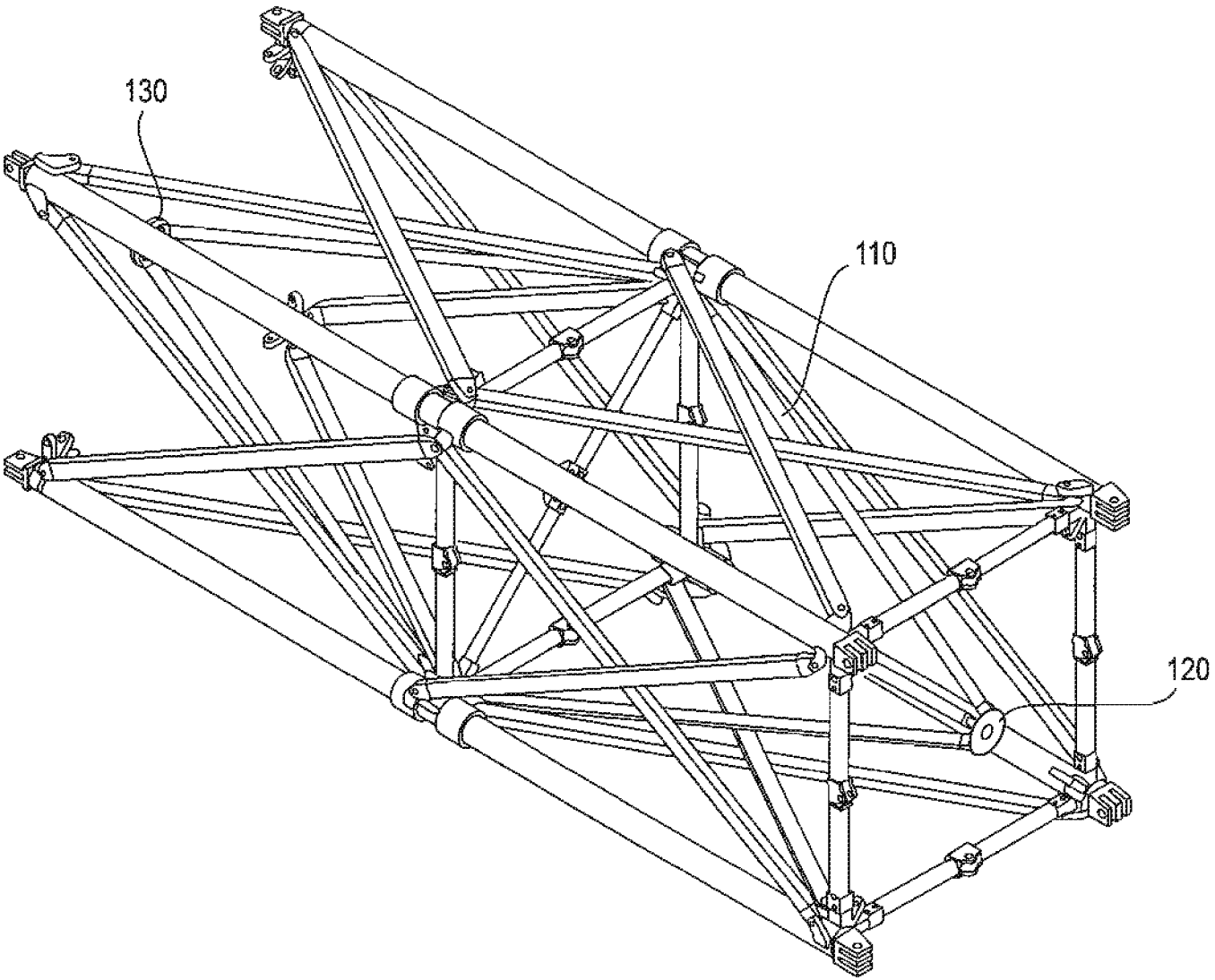
FIGS. 9, 10: the lattice support structure in further embodiments in accordance with the present invention in the state folded apart.

FIG. 9 shows the lattice support structure in accordance with the invention in a further embodiment. Struts 110 are provided in this embodiment which extend from a centrally arranged element 120 to the longitudinally extending supports 10. In the state ready for operation shown in FIG. 9, the struts 110 extend at an acute angle to the longitudinally extending supports 10. The struts 110 are arranged pivotably both at the supports 10 and at the central element 120.

Figure 12:
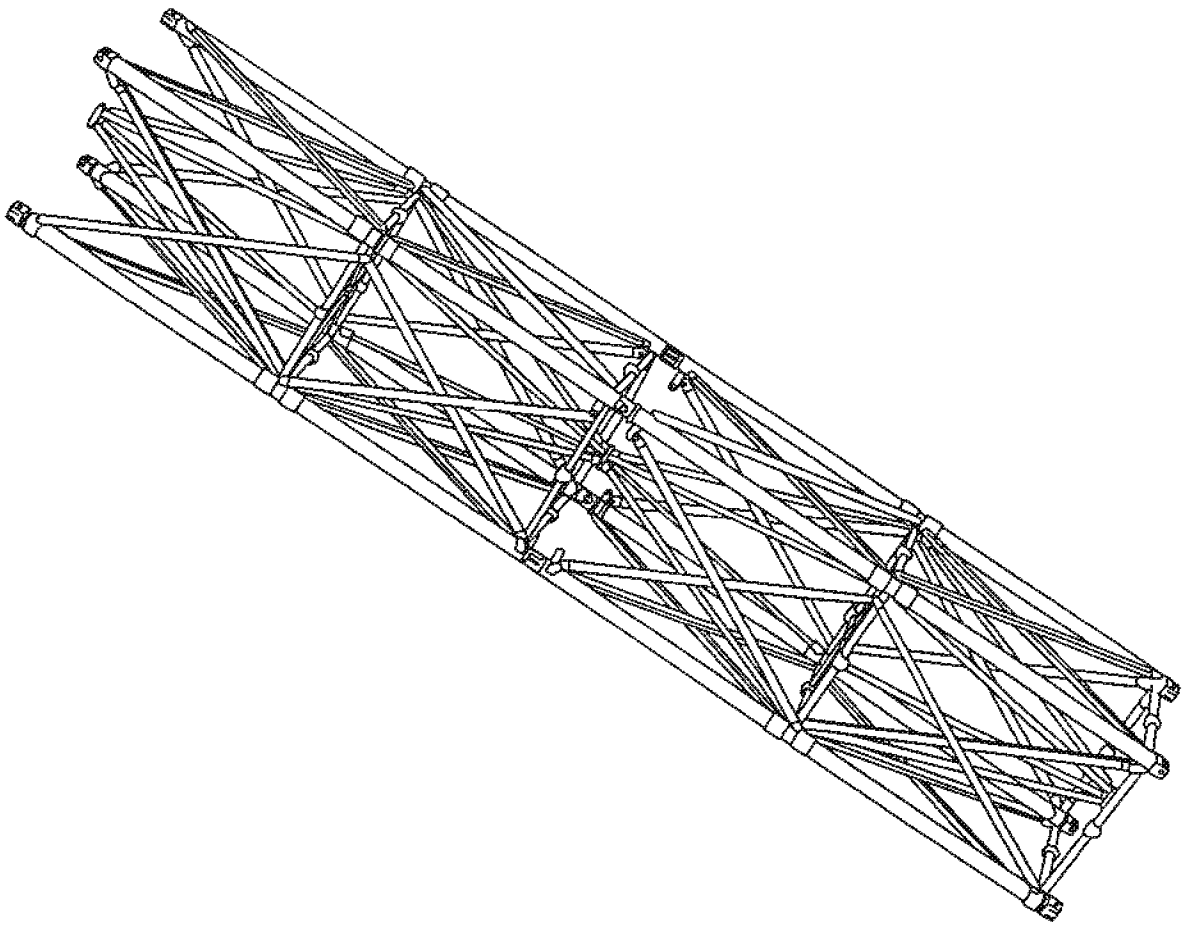
FIG. 12: a representation of the lattice support structure in accordance with the invention corresponding to FIGS. 9 and 10 with a plurality of lattice support structure segments set adjacent to one another.

As can furthermore be seen from FIG. 9, this strut arrangement is continued downwardly with mirror symmetry. The struts 110 open into a further central element 130 there. These central elements 120 and 130 can be connected in the assembled state of the lattice support structure to the adjacent segments of the lattice support structure such that a continuous system results as is shown in FIG. 12. It is possible in this manner to effect a folding in and a folding apart of the total lattice support structure by a corresponding actuation of the central elements.

Figure 11:
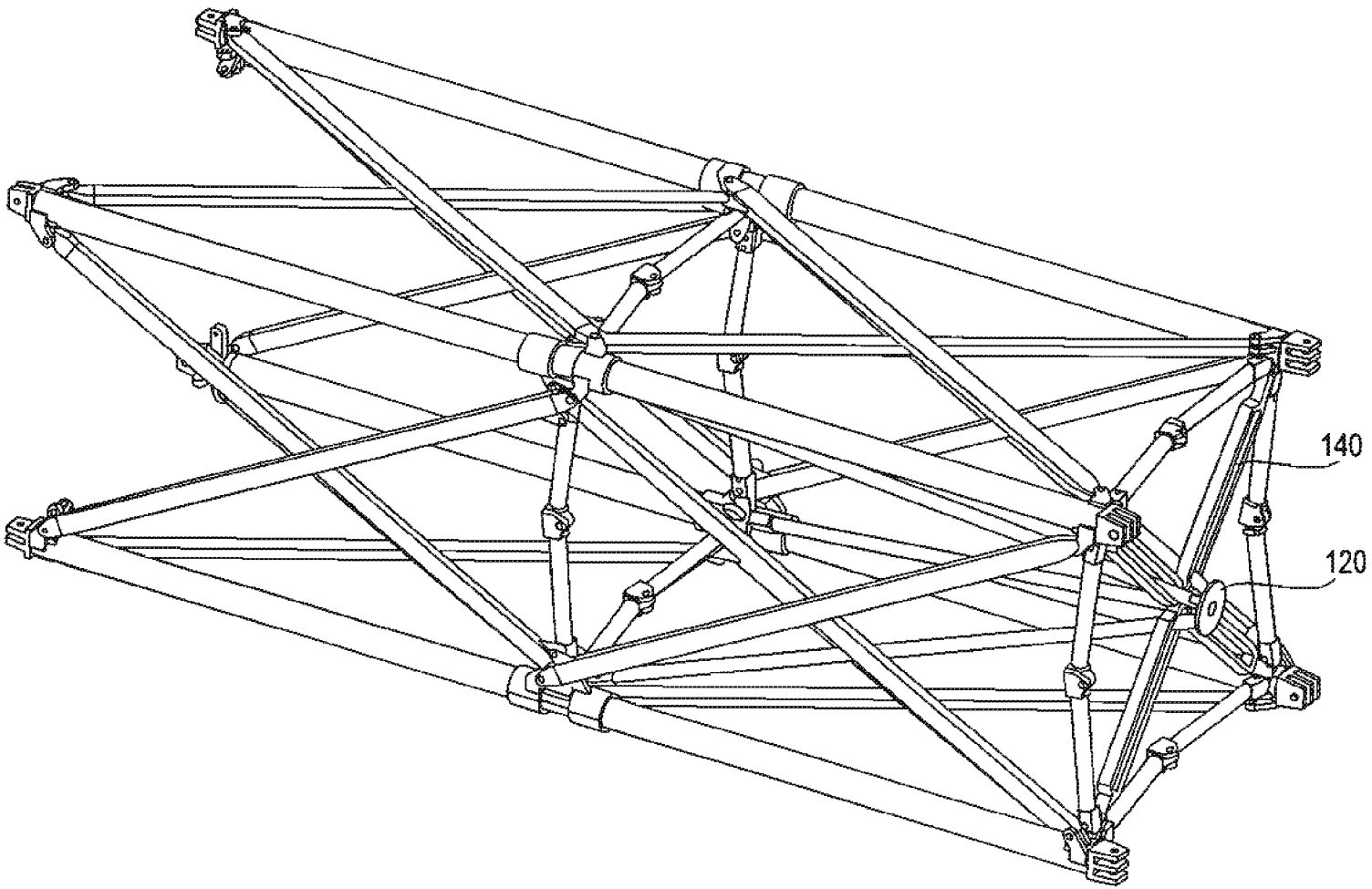
FIG. 11: the lattice support structure in accordance with a further embodiment in accordance with the present invention in the state folded apart.

FIG. 11 shows an embodiment in which this strut arrangement does not repeat downwardly, but is rather only made at a half-side with respect to the lattice support structure segment.

Figure 10:
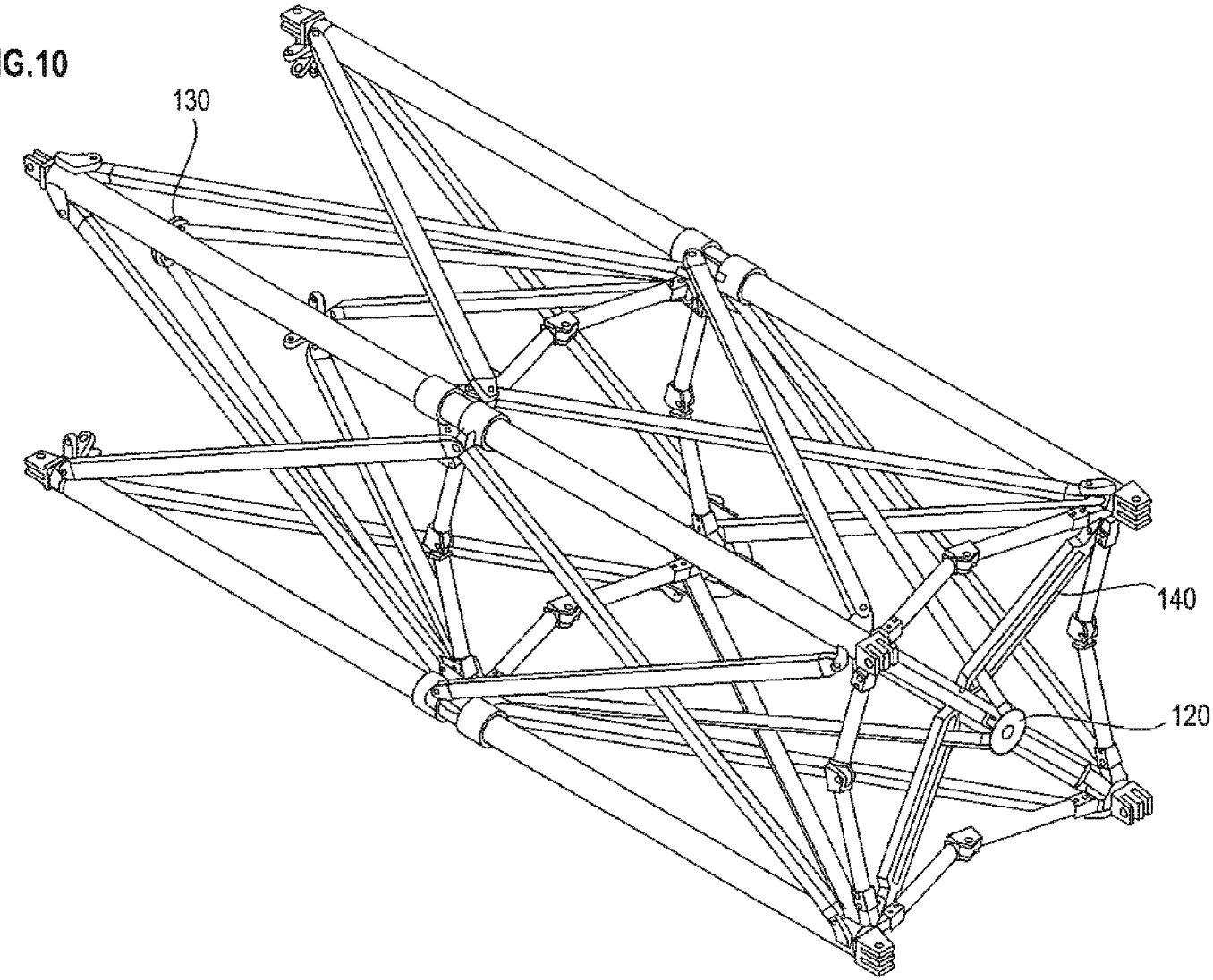

As finally can furthermore be seen from a comparison of FIGS. 9 and 10, connection struts can also be provided in this embodiment of the invention which extend diagonally between two obliquely oppositely disposed supports 10. These connection struts are marked by the reference numeral 140 in FIGS. 10 and 11. These struts can, in accordance with the embodiment shown above, likewise be used to secure the lattice support structure in the position folded apart.

The invention claimed is:

1. A lattice support structure having longitudinally extending supports (10) which are connected to one another by obliquely extending struts (20) and are also connected to one another in the state of the lattice support structure ready for operation by transversely extending struts (30) provided with a joint (32), with the struts (20, 30) being pivotably connected to two respective preferably adjacent supports (10), with at least one connection strut (40) being provided which connects two supports (10) to one another which are not adjacent to one another and which are preferably disposed opposite one another, and with the at least one connection strut (40) and/or at least one component (50) of the lattice support structure connected thereto having fastening means or being connected or connectable thereto, with the fastening means being made such that they prevent a folding together of the lattice support structure in at least one position, wherein the fastening means include a first (62) and second fastening element (64), and the connection strut (40) is connected to the first fastening element (62), with first and second levers (50) each being pivotally connected to the at least one connection strut (40), said first and second levers (50) also being pivotally connected to the second fastening element (64), and with the fastening elements (62, 64) being arranged such that they can be connected to one another.

2. A lattice support structure in accordance with claim 1, wherein two connection struts (40, 42) are provided which are both connected to the first fastening element (62).

3. A lattice support structure in accordance with claim 2, wherein the struts (40, 42), first and second fastening elements (62, 64) and levers (50) are arranged with respect to one another, such that in a partially-folded state, the levers (50) project at a comparatively large angle from the respective connection struts (40, 42) and the fastening elements (62, 64) are spaced comparatively far apart from one another, and in a folded-apart state, the levers (50) are disposed approximately parallel to or at an acute angle to the respective connection struts (40, 42) and the spacing of the fastening elements (62, 64) from one another is comparatively small.

4. A lattice support structure in accordance with claim 1, wherein the at least one connection strut (40, 42) is pivotably connected to the first fastening element (62).

5. A lattice support structure in accordance with claim 1, wherein the fastening means or fastening elements (62, 64) are made such that they can be connected to one another by a clip (70).

6. A lattice support structure in accordance with claim 1, wherein one of the fastening elements (62) of the fastening means has a flange-like part (66) and pins (67) extending from it; and the other one of the fastening elements (64) of the fastening means has a flange-like part (68) which has cut-outs (69) in which the pins (67) can be at least partially received.

7. A lattice support structure in accordance with claim 6, additionally comprising a clip (70) arranged to be pivoted around the received sections (69) of the pins (67) and the flange (68) such that moving apart of the fastening elements (62, 64) from one another is precluded in folded-out condition.

8. A lattice support structure in accordance with claim 1, wherein the transversely extending struts (30) provided with a joint (32) are spaced apart from one another in the longitudinal direction; and a connection element (90) is provided which connects two joints (32) of two such struts (30) to one another.

9. A lattice support structure in accordance with claim 1, wherein a blocking element (100) is provided which prevents an inward pivoting of the transversely extending struts (30) in the state of the lattice support structure ready for operation.

10. A lattice support structure in accordance with claim 9, wherein the blocking element (100) is made to be self-locking.

11. A lattice support structure in accordance with claim 1, wherein the lattice support structure has struts which are made in the form of a pyramid or in the form of a truncated pyramid.

12. A crane, wherein the crane comprises one or more lattice support structures in accordance with claim 1 or has at least one such support structure.

13. A lattice support structure in accordance with claim 1, comprising four longitudinally-extending supports (10),
eight transversely-extending struts (30),
eight obliquely-extending struts (20), and
four connection struts (40, 42).

14. A lattice support structure in accordance with claim 13, comprising sixteen obliquely-extending struts (20).

15. A lattice support structure having spreadable structures and longitudinally extending supports (10) which are connected to one another by obliquely extending struts (20) and are also connected to one another in the state of the lattice support structure ready for operation by transversely extending struts (30) provided with a joint (32), with the struts (20, 30) being pivotably connected to two respective preferably adjacent supports (10), with at least one connection strut (40) being provided which connects two supports (10) to one another which are not adjacent to one another and which are preferably disposed opposite one another, and with the at least one connection strut (40) and/or at least one component (50) of the lattice support structure connected thereto having fastening means or being connected or connectable thereto, with the fastening means being made such that they prevent a folding together of the lattice support structure in at least one position, wherein the lattice support structure has pivotably arranged lattice bars, with the pivotable connection being made such that one of the mutually pivotably connected parts has a projection; and the other of the pivotably connected parts has a groove which is bounded by walls on three sides and in which the projection of the other part is pivotably received.

* * * * *